US009650307B2

(12) United States Patent
Velarde et al.

(10) Patent No.: US 9,650,307 B2
(45) Date of Patent: May 16, 2017

(54) METHODS FOR PRODUCING DEMN EUTECTIC

(71) Applicant: Orbital ATK, Inc., Dulles, VA (US)

(72) Inventors: Stephen P. Velarde, Christiansburg, VA (US); Harold E. Johnston, Pearland, TX (US)

(73) Assignee: Orbital ATK, Inc., Plymouth, MN (US)

( * ) Notice: Subject to any disclaimer, the term of this patent is extended or adjusted under 35 U.S.C. 154(b) by 469 days.

(21) Appl. No.: 13/804,148

(22) Filed: Mar. 14, 2013

(65) Prior Publication Data

US 2014/0261930 A1 Sep. 18, 2014

(51) Int. Cl.

*C06B 25/34* (2006.01)
*C06B 25/00* (2006.01)
*C06B 21/00* (2006.01)

(52) U.S. Cl.

CPC ..... *C06B 25/34* (2013.01); *C06B 21/00* (2013.01); *C06B 21/005* (2013.01); *C06B 25/00* (2013.01)

(58) Field of Classification Search

CPC ..... C06B 21/00; C06B 25/00
See application file for complete search history.

(56) References Cited

U.S. PATENT DOCUMENTS 4,353,758 A 10/1982 Akst et al.
4,419,155 A 12/1983 Wagaman et al.
4,421,578 A * 12/1983 Voreck, Jr. ..... 149/2
5,030,763 A 7/1991 Olsen et al.
5,145,535 A 9/1992 Patrick
8,663,406 B1 * 3/2014 Aubert et al. ..... 149/88

FOREIGN PATENT DOCUMENTS

GB 384966 12/1932

OTHER PUBLICATIONS

PCT International Search Report, ISA/EP, International Application No. PCT/US2014/018901, dated Aug. 27, 2014, three (3) pages.
Written Opinion of the International Searching Authority, International Application No. PCT/US2014/018901, dated Aug. 27, 2014, six (6) pages.
Dobratz, B.M., Ethylenediamine Dinitrate and its Eutectic Mixtures: A Historical Review of the Literature to 1982,: Los Alamos National Laboratory, May 1983.
Lee, K.-Y., "Development of New Ammonium Nitrate Composite Explosives," Los Alamos National Laboratory, Final Technical Report, Mar. 1985.
McKenney, Jr. et al., Synthesis and Properties of Selected Energetic Organodi- and Polyammonium Nitrate Salts" AFATL-TR-86-08, Apr. 1986.
Pacanowsky et al., "Development of the IMX Double Direct Process," ADPA Meeting, May 1982.

* cited by examiner

*Primary Examiner* — Aileen B Felton
(74) *Attorney, Agent, or Firm* — TraskBritt

(57) ABSTRACT

A method of producing DEMN eutectic comprises reacting a reactant mixture comprising ethylenediamine and diethylenetriamine with aqueous nitric acid to form a reaction mixture comprising diethylentriamine trinitrate and ethylenediamine dinitrate. The reaction mixture is combined with methylnitroguanidine and nitroguanidine to form an aqueous slurry. Water is removed from the aqueous slurry. A method of producing an energetic composition, and a system for producing DEMN eutectic are also described.

17 Claims, 3 Drawing Sheets

METHODS FOR PRODUCING DEMN EUTECTIC

FIELD

The disclosure, in various embodiments, relates generally to methods and systems for producing a eutectic composition, and to related methods of producing energetic compositions. More specifically, the disclosure relates to methods and systems for producing DEMN eutectic, and to related methods of producing energetic compositions including the DEMN eutectic.

BACKGROUND

Energetic (e.g., explosive) materials that have reduced sensitivity and increased performance for use in melt-pour energetic compositions are being investigated. One such energetic material is DEMN eutectic, a quaternary eutectic composition of diethylentriamine trinitrate (DETN), ethylenediamine dinitrate (EDDN), methylnitroguanidine (MeNQ), and nitroguanidine (NQ).

In a conventional process of forming DEMN eutectic, the DETN and the EDDN are separately produced by forming distinct aqueous solutions of diethylenetriamine (DETA) (i.e., to produce DETN) and ethylenediamine (EDA) (i.e., to produce EDDN), cooling each of the aqueous solutions below 10° C., slowly adding aqueous 70% nitric acid ($NHO_3$) to each of the aqueous solutions while maintaining a reaction temperature at or below 25° C., adding ethanol to the resulting reaction mixtures to precipitate the DETN and the EDDN, cooling and filtering the resulting slurries to form cakes of the DETN and the EDDN, and washing the cakes of the DETN and the EDDN with ethanol to remove residual $NHO_3$ and water. Thereafter, predetermined ratios of the DETN and the EDDN are wetted with ethanol and combined with predetermined ratios of MeNQ and NQ, the resulting mixture is heated to a temperature of from about 95° C. to about 105° C. under agitation to remove the ethanol, and the resulting molten DEMN eutectic is utilized as desired.

Unfortunately, while the foregoing process may produce the DEMN eutectic, the process can be inefficient and cost-prohibitive. For example, the process is time and labor intensive, and contaminated waste streams (e.g., ethanol contaminated with DETN and/or EDDN) generated throughout the process (e.g., to form the DETN, to form the EDDN, and to form the DEMN) can require special processing to mitigate health, safety, and environmental concerns related thereto.

It would, therefore, be desirable to have new methods and systems for producing DEMN eutectic that are efficient, easy to employ, cost-effective, and environmentally friendly as compared to conventional methods and systems for producing DEMN eutectic. Such methods and systems may, for example, facilitate increased adoption and use of DEMN eutectic in military applications.

SUMMARY

Embodiments described herein include methods and systems for producing DEMN eutectic, and related methods of producing energetic materials. For example, in accordance with an embodiment described herein, a method of producing DEMN eutectic comprises reacting a reactant mixture comprising ethylenediamine and diethylenetriamine with aqueous nitric acid to form a reaction mixture comprising diethylentriamine trinitrate and ethylenediamine dinitrate. The reaction mixture is combined with methylnitroguanidine and nitroguanidine to form an aqueous slurry. Water is removed from the aqueous slurry.

In additional embodiments, a method of producing an energetic material comprises reacting a reactant mixture comprising ethylenediamine and diethylenetriamine with an aqueous solution comprising from about 60 percent by weight nitric acid to about 75 percent by weight nitric acid at a temperature of from about 10° C. to about 90° C. to form a reaction mixture comprising ethylenediamine dinitrate and diethylentriamine trinitrate and exhibiting a pH within a range of from about 0 to about 7. The reaction mixture is combined with methylnitroguanidine and nitroguanidine to form an aqueous slurry. The aqueous slurry is heated at a temperature of from about 50° C. to about 150° C. and under at least one of negative pressure and air sparge to form a DEMN eutectic comprising ethylenediamine dinitrate, diethylentriamine trinitrate, methylnitroguanidine, nitroguanidine, and from about 0.1 percent by weight water to about 2 percent by weight water.

In yet still additional embodiments, a system for producing a DEMN eutectic comprises at least one vessel configured to react a reactant mixture comprising diethylenetriamine and ethylenediamine and aqueous nitric acid at a temperature of from about 10° C. to about 90° C. to produce a reaction mixture comprising ethylenediamine dinitrate and diethylentriamine trinitrate, to combine the reaction mixture with methylnitroguanidine and nitroguanidine to form an aqueous slurry, and to heat the aqueous slurry at a temperature of from about 50° C. to about 150° C.

DETAILED DESCRIPTION

Figure 1:
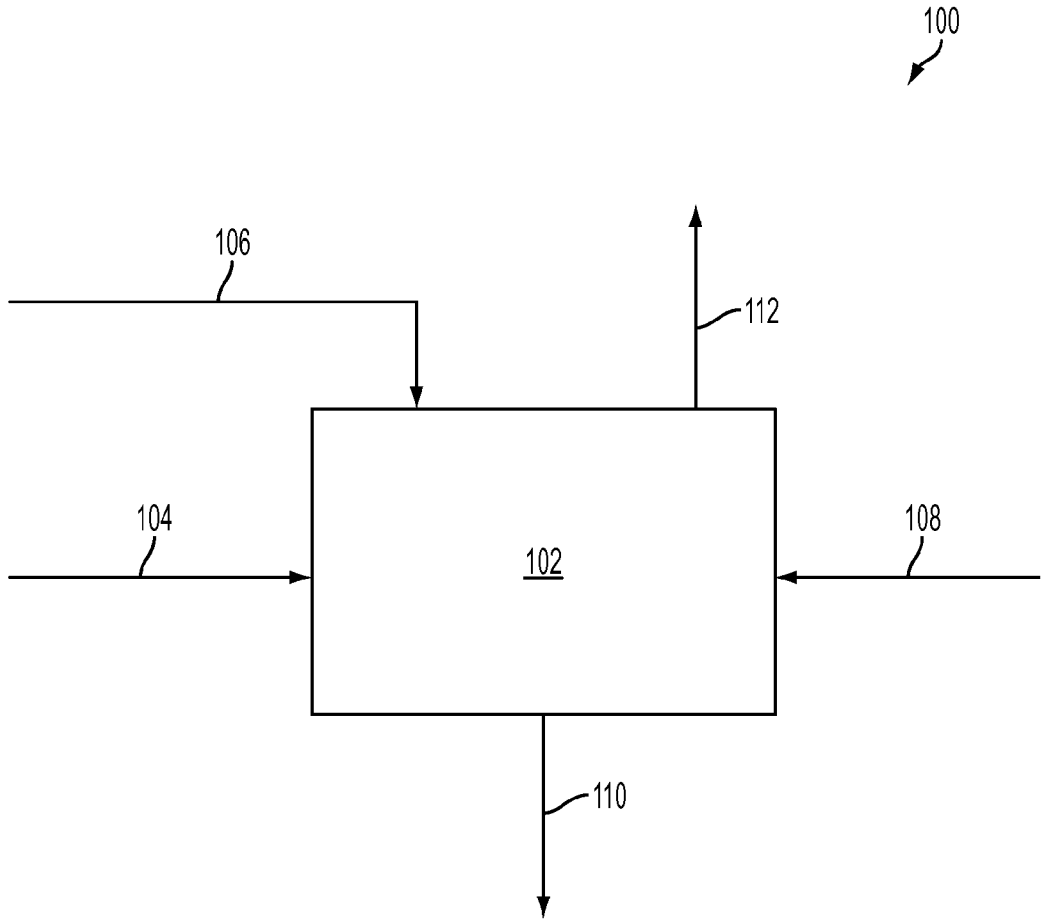
FIG. 1 is simplified schematic view of a DEMN eutectic production system, in accordance with embodiments of the disclosure.

The following description provides specific details, such as material compositions, and processing conditions (e.g., temperatures, pressures, flow rates, etc.) in order to provide a thorough description of embodiments of the present disclosure. However, a person of ordinary skill in the art will understand that the embodiments of the present disclosure may be practiced without employing these specific details. Indeed, the embodiments of the disclosure may be practiced in conjunction with conventional systems and methods employed in the industry. In addition, only those process components and acts necessary to understand the embodiments of the present disclosure are described in detail below. A person of ordinary skill in the art will understand that some process components (e.g., pipelines, line filters, valves, temperature detectors, flow detectors, pressure detectors, and the like) are inherently included herein and that adding various conventional process components and acts would be in accord with the present disclosure. The drawings accompanying the present application are for illustrative purposes only, and are not meant to be actual views of any particular material, device, or system. Additionally, elements common between figures may retain the same numerical designation.

Methods and systems for producing DEMN eutectic are described, as are related methods of producing energetic compositions including the DEMN eutectic. As used herein, the term "eutectic" means and includes a composition of at least two constituents that melts substantially completely to form a single liquid at a temperature below the melting point of any of the constituents. Accordingly, as used herein the term "DEMN eutectic" means and includes a composition of DETN, EDDN, MeNQ, and NQ that melts substantially completely to form a single liquid at a temperature below the melting point of any one of the DETN, EDDN, MeNQ, and NQ. In some embodiments, a method of producing DEMN eutectic includes reacting a reactant mixture including ethylenediamine (EDA) and diethylenetriamine (DETA) with an aqueous $NHO_3$ to form a reaction mixture including DETN and EDDN. The reaction mixture is combined with MeNQ and NQ to form an aqueous slurry. Water is removed from the aqueous slurry using heat, and at least one of negative pressure and air sparge to form the DEMN eutectic. The methods and systems of embodiments of the disclosure may be faster, more efficient, more cost-effective, and more environmentally friendly than conventional methods and systems used to form DEMN eutectic.

A reaction scheme for the preparation of DEMN eutectic according to embodiments of the disclosure is shown below:

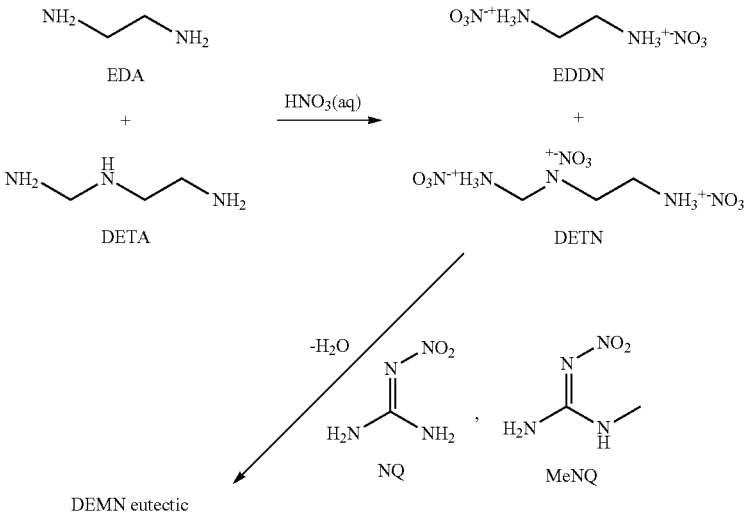

The reaction scheme is described in detail below.

Aqueous $NHO_3$ may be combined with a reactant mixture including EDA and DETA to form a reaction mixture including EDDN and DETN, according to the following reaction schemes:

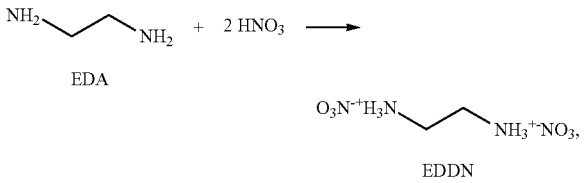

-continued

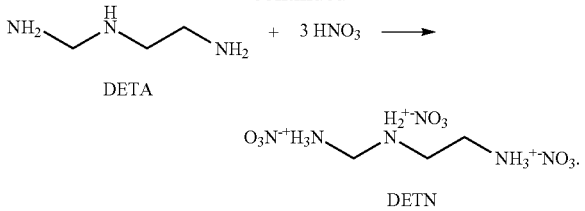

The amounts of EDA and DETA included in the reactant mixture may depend on amounts of EDDN and DETN to be included in the DEMN eutectic to be formed. For example, EDA may be included in the reactant mixture in an amount enabling the DEMN eutetic ultimately produced to comprise from about 10 percent by weight (wt %) EDDN to about 50 wt % EDDN, such as from about 20 wt % EDDN to about 40 wt % EDDN, or from about 25 wt % EDDN to about 35 wt % EDDN. In addition, DETA may be included in the reactant mixture in an amount enabling the DEMN eutetic ultimately produced to comprise from about 10 percent by weight (wt %) DETN to about 50 wt % DETN, such as from about 20 wt % DETN to about 40 wt % DETN, or from about 25 wt % DETN to about 35 wt % DETN. EDA and DETA are each commercially available from various sources, such as from Sigma-Aldrich Co. (St. Louis, Mo.). The aqueous $NHO_3$ may include from about 60 wt % $NHO_3$ to about 75 wt % $NHO_3$, and from about 40 wt % water ($H_2O$) to about 25 wt % $H_2O$. In some embodiments, the aqueous $NHO_3$ includes about 70 wt % $NHO_3$, and about 30 wt % $H_2O$. Aqueous nitric acid is commercially available from various sources, such as from Sigma-Aldrich Co. (St. Louis, Mo.), or may be diluted with water to achieve the desired concentration.

The aqueous $NHO_3$ may be combined with the reactant mixture within any reaction vessel (e.g., glass-lined reactor, round-bottom flask, etc.) compatible with the conditions of the reaction. The aqueous $NHO_3$ and the reactant mixture may be simultaneously added to the reaction vessel, or may be sequentially added to the reaction vessel. If sequentially added to the reaction vessel, the aqueous $NHO_3$ may be added to the reaction vessel before the reactant mixture, or the aqueous $NHO_3$ may be added to the reaction vessel after the reactant mixture. In additional embodiments, the EDA and the DETA may be added to the reaction vessel separately (i.e., rather than as the reactant mixture). The aqueous $NHO_3$ may be combined with the reactant mixture under agitation (e.g., stirring) and at a sufficient rate to maintain a reaction temperature of from about 10° C. to about 90° C., such as from about 35° C. to about 55° C. A cooling source may, optionally, be used to maintain the reaction temperature within the desired range within the reaction vessel. The amount of the aqueous $NHO_3$ combined with the reactant mixture may be controlled such that a final pH of the resulting reaction mixture is within a range of from about 0 to about 7, such as from about 3 to about 5. If the reaction mixture is too basic undesirable ageing properties may result. Conversely, if the reaction mixture is too acidic it may be too corrosive for one or more desired applications.

Following formation, the reaction mixture may be combined with NQ and MeNQ to form an aqueous slurry including EDDN, DETN, NQ, MeNQ, and water. As used herein, the term "aqueous slurry" means and includes a suspension of EDDN, DETN, NQ, and MeNQ in water, a solution of EDDN, DETN, NQ, and MeNQ in water, an emulsion of EDDN, DETN, NQ, and MeNQ in water, or combinations thereof. Since a person of ordinary skill in the art will recognize whether a particular formulation is a suspension, a solution, an emulsion, or a combination thereof from the context, for the purposes of readability and claiming the invention, the term "slurry" means and includes a suspension, a solution, an emulsion, or a combination thereof. The amounts of NQ and MeNQ combined with the reaction mixture may depend on amounts of NQ and MeNQ to be included in the DEMN eutectic to be formed. For example, the amount of NQ combined with the reactant mixture may enable the DEMN eutetic ultimately produced to comprise from about 1 wt % NQ to about 10 wt % NQ, such as from about 2 wt % NQ to about 8 wt % NQ, or from about 3 wt % NQ to about 7 wt % NQ. In addition, the amount of MeNQ combined with the reactant mixture may enable the DEMN eutetic ultimately produced to comprise from about 5 wt % MeNQ to about 40 wt % MeNQ, such as from about 10 wt % MeNQ to about 35 wt % MeNQ, or from about 20 wt % MeNQ to about 30 wt % MeNQ. NQ is commercially available from various sources, such as from Sigma-Aldrich Co. (St. Louis, Mo.). MeNQ may be synthesized from NQ using conventional processes, which are not described in detail herein.

The NQ and the MeNQ may be simultaneously combined with the reaction mixture (e.g., as a mixture of NQ and MeNQ), or may be sequentially (e.g., separately) combined with the reaction mixture. If sequentially combined with the reaction mixture, the NQ may be combined with the reaction mixture before the MeNQ is combined with the reaction mixture, or the NQ may be combined with the reaction mixture after the MeNQ is combined with the reaction mixture. In some embodiments, the NQ and the MeNQ are sequentially combined with the reaction mixture. The NQ, the MeNQ, or the mixture thereof, may be introduced to (e.g., added to) the reaction mixture in a single aliquot, or in multiple aliquots. If combined with the reaction mixture in multiple aliquots, the NQ, the MeNQ, or the mixture thereof, may be introduced to the reaction mixture in stepwise manner, or in a continuous manner.

The NQ and the MeNQ may each be combined with the reaction mixture in a dry state, or at least one of the NQ and the MeNQ may be combined with the reaction mixture in a wet state. As used herein, the phrase "in a dry state" means that a material (e.g., NQ, MeNQ, etc.) is substantially free of the presence of water or another solvent. If in a dry state, at least one of the NQ and the MeNQ may, for example, be combined with the reaction mixture as a plurality of particles, such as a powder of NQ, a powder of MeNQ, or a powder of NQ and MeNQ. Conversely, as used herein, the phrase "in a wet state" means that a material (e.g., NQ, MeNQ, etc.) is in the presence of (e.g., at least partially dissolved in) water or another solvent. If in a wet state, at least one of the NQ and the MeNQ may, for example, be combined with the reaction mixture as a water-containing material including water and the at least one of NQ and MeNQ. The water-containing material may include from about 1 wt % water ($H_2O$) to about 50 wt % $H_2O$, such as from about 10 wt % $H_2O$ to about 40 wt % $H_2O$, or from about 20 wt % $H_2O$ to about 30 wt % $H_2O$.

Upon and/or during formation, the aqueous slurry may be heated to a temperature of from about 50° C. to about 150° C., such as from about 90° C. to about 110° C. under at least one of negative pressure (e.g., a vacuum) and air sparge to remove $H_2O$. The water may be removed from the aqueous slurry in situ. In additional embodiments, at least one of the reaction mixture, the NQ, and the MeNQ may be heated to the temperature of from about 50° C. to about 150° C. prior to the formation of the aqueous slurry. For example, the reaction mixture may be heated to the temperature of from about 50° C. to about 150° C. before introducing the NQ and the MeNQ thereto. The $H_2O$ removed from the aqueous slurry may be substantially free of EDDN, DETN, NQ, and MeNQ. The $H_2O$ removal process may continue for a sufficient amount of time to form the DEMN eutectic. The DEMN eutectic may be in a molten (e.g., liquid, melted) state that includes from about 0.1 wt % water to about 2 wt % water, such as from about 0.3 wt % water to about 0.5 wt % water. The DEMN eutectic may remain in the molten state at a temperature greater than or equal to about 90° C. Accordingly, the temperature of the DEMN eutectic may be temporarily maintained at a temperature greater than or equal to about 90° C., such as from about 90° C. to about 120° C., or from about 105° C. to about 115° C.

The DEMN eutectic may be utilized as desired. For example, the DEMN eutectic may be poured into a thin sheet and allowed to solidify, and/or may be formed (e.g., prilled) into particles (e.g., beads, flakes, etc.) of a desired shape (e.g., spherical, hexahedral, ellipsoidal, cylindrical, conical, irregular, etc.) and size for at least one of storage and shipment. As another example, the DEMN eutectic may be poured into a desired configuration (e.g., a grenade body, an artillery shell, a mortar shell, a bomb casing, a shaped charge, etc.) for a desired end-use application. As an additional example, at least one of the molten DEMN eutectic and a solid form (e.g., a powder form) of the DEMN eutectic may be combined with another energetic material to produce a DEMN-based energetic composition. The another energetic material may be at least one of a crystalline energetic material and a non-crystalline energetic material including, but not limited to, crystalline and non-crystalline forms of 1,3,5-triaza-1,3,5-trinitocyclohexane (RDX), 1,3,5,7-tetraaza-1,3,5,7-tetranitrocyclooctane (HMX), 2,4,6-trinitrotoluene (TNT), 2,4,6-triamino-1,3,5-trinitrobenzene (TATB), 3-nitro-1,2,4-triazol-5-one (NTO), 4,10-Dinitro-2,6,8,12-tetraoxa-4,10-diaza-tetracyclododecane (TEX), 1,1-diamino-2,2-dinitroethene (FOX-7), 2,4,6,8,10,12-hexanitro-2,4,6,8,10,12-hexaazaisowurtzitane (CL-20), NQ, or combinations thereof.

FIG. 1 illustrates a DEMN eutectic production system 100 in accordance with embodiments of the disclosure. As shown in FIG. 1, the DEMN eutectic production system 100 includes a reaction vessel 102. The reaction vessel 102 may be configured to receive a reactant feed stream 104 including DETA and EDA, an aqueous $NHO_3$ stream 106, and a stream 108 of NQ and MeNQ to produce a molten DEMN eutectic stream 110 and a waste water stream 112. By way of non-limiting example, the reaction vessel 102 may be a 5-, 50-, or 500-gallon Pfaudler type glass-lined reactor including inlets to receive the reactant feed stream 104, the aqueous $NHO_3$ stream 106, and the stream 108 of NQ and MeNQ, and outlets to remove the molten DEMN eutectic stream 110 and a waste water stream 112. In additional embodiments, the reaction vessel 102 may be configured to receive at least one of separate DETA and EDA streams and separate NQ and MeNQ streams. In operation, the reaction vessel 102 may receive and contain the reactant feed stream 104 and the aqueous $NHO_3$ stream 106 so that the DETA, EDA, and $NHO_3$ react in accordance with the methods previously described (e.g., at a temperature of from about 10° C. to about 90° C., and at a pH within a range of from about 0 to about 7) to produce a reaction mixture including EDDN and DETN. The reaction vessel 102 may then receive the stream 108 of NQ and MeMQ, and may combine the NQ and MeMQ with the reaction mixture to form an aqueous slurry including EDDN, DETN, MeNQ, NQ, and $H_2O$. The operating temperature of the reaction vessel 102 may be increased (e.g., to a temperature of from about 50° C. to about 150° C.), and at least one of negative pressure and air sparging may be applied to remove $H_2O$ (e.g., as steam) from the aqueous slurry and form molten DEMN eutectic in accordance with the methods previously described. The water may be removed from the reaction vessel 102 in situ. The removed $H_2O$ may exit the reaction vessel 102 as the waste water stream 112, and may be utilized or disposed of as desired. The molten DEMN eutectic may exit the reaction vessel 102 as the molten DEMN eutectic stream 110, and may also be utilized as desired.

Figure 2:
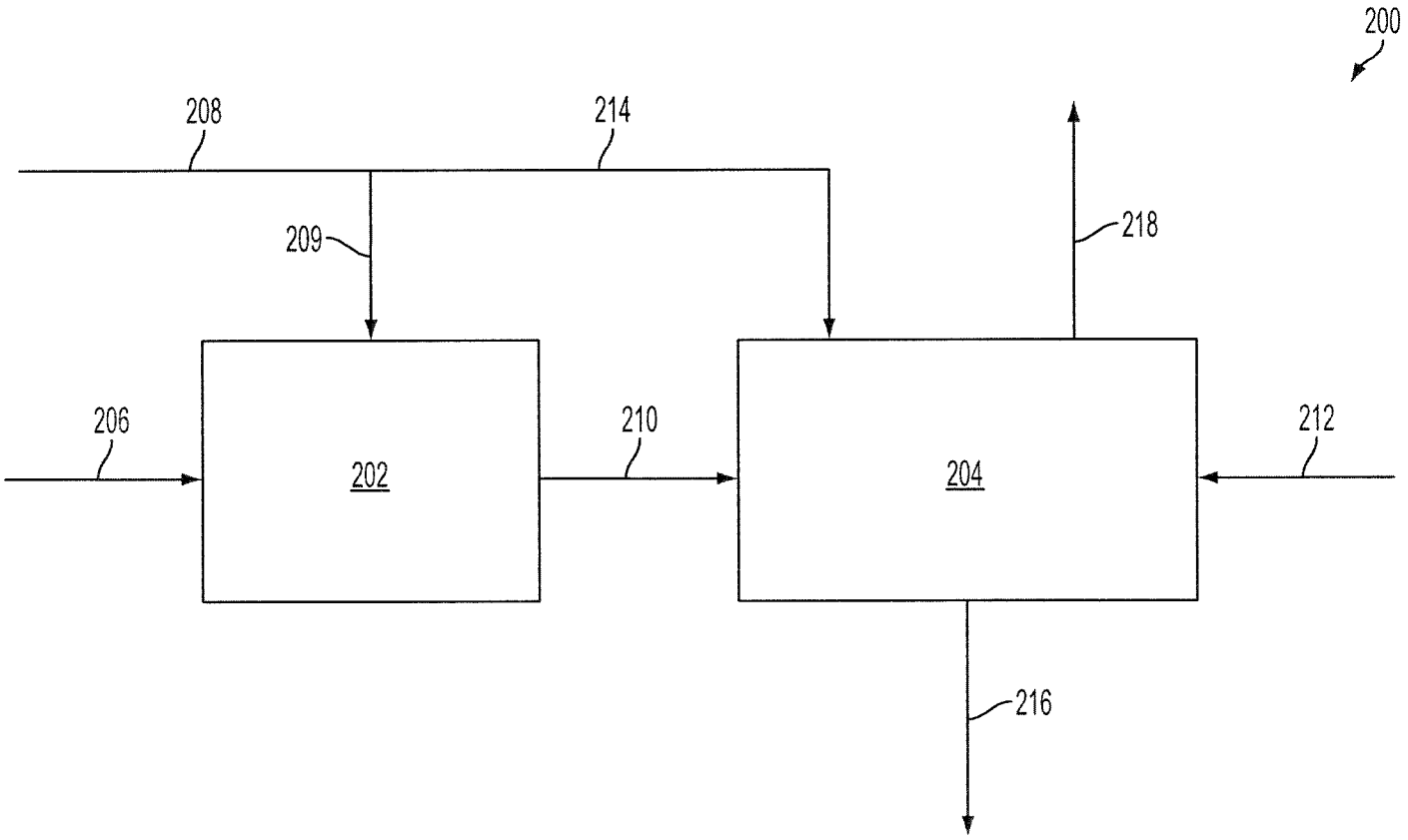
FIG. 2 is simplified schematic view of a DEMN eutectic production system, in accordance with additional embodiments of the disclosure.

In additional embodiments, a DEMN eutectic production system of the disclosure may be configured as depicted in FIG. 2. As shown in FIG. 2, a DEMN eutectic production system 200 may include a first reaction vessel 202, and a second reaction vessel 204. The first reaction vessel 202 may be configured to receive and react a reactant feed stream 206 comprising DETA and EDA and at least a portion 209 of an aqueous $NHO_3$ stream 208 to produce a reaction mixture stream 210 comprising EDDN and DETN in accordance with the methods previously described herein (e.g., at a temperature of from about 10° C. to about 90° C., and at a pH within a range of from about 0 to about 7). In turn, the second reaction vessel 204 may be configured to receive the reaction mixture stream 210 from the first reaction vessel 202 along with a stream 212 of NQ and MeNQ to form an aqueous slurry of the EDDN, DETN, MeNQ, NQ, and $H_2O$, and produce a waste water stream 218 and a molten DEMN eutectic stream 216 in accordance with the methods previously described herein (e.g., at a temperature of from about 50° C. to about 150° C., and under at least one of negative pressure and air sparging). The second reaction vessel 204 may, optionally, also be configured to receive another portion 214 of the aqueous $NHO_3$ stream 208 (e.g., to adjust the pH of the aqueous slurry).

The methods and systems of the disclosure may increase production efficiency, reduce costs, improve yield, and mitigate health, safety, and environmental concerns as compared to conventional methods and systems for producing DEMN eutetic. For example, the methods and systems of the disclosure may reduce the number of processing acts and the amount of processing equipment utilized to produce DEMN eutetic as compared to conventional methods and systems, increasing efficiency (e.g., faster production time), increasing yield, reducing labor and equipment costs, and enhancing safety (e.g., through reduced exposure) relative to such conventional methods and systems. In addition, the methods and systems of the disclosure may reduce the number of materials (e.g., reagents) utilized to produce DEMN eutetic as compared to conventional methods and systems (e.g., which may require the use of an organic solvent, such as ethanol), reducing material and processing costs relative to such conventional methods and systems. Furthermore, waste streams (e.g., waste water streams) produced through methods and systems of the disclosure may be non-volatile and substantially free of hazardous contaminants (e.g., EDDN, DETN, MeNQ, NQ) as compared to waste streams (e.g., energetic-contaminated ethanol streams) produced through conventional methods and systems, enhancing safety, reducing processing costs, and mitigating environmental concerns relative to such conventional methods and systems.

The following examples serve to explain some embodiments of the disclosure in more detail. The examples are not to be construed as being exhaustive or exclusive as to the scope of the disclosure.

EXAMPLES

Example 1

Figure 3:
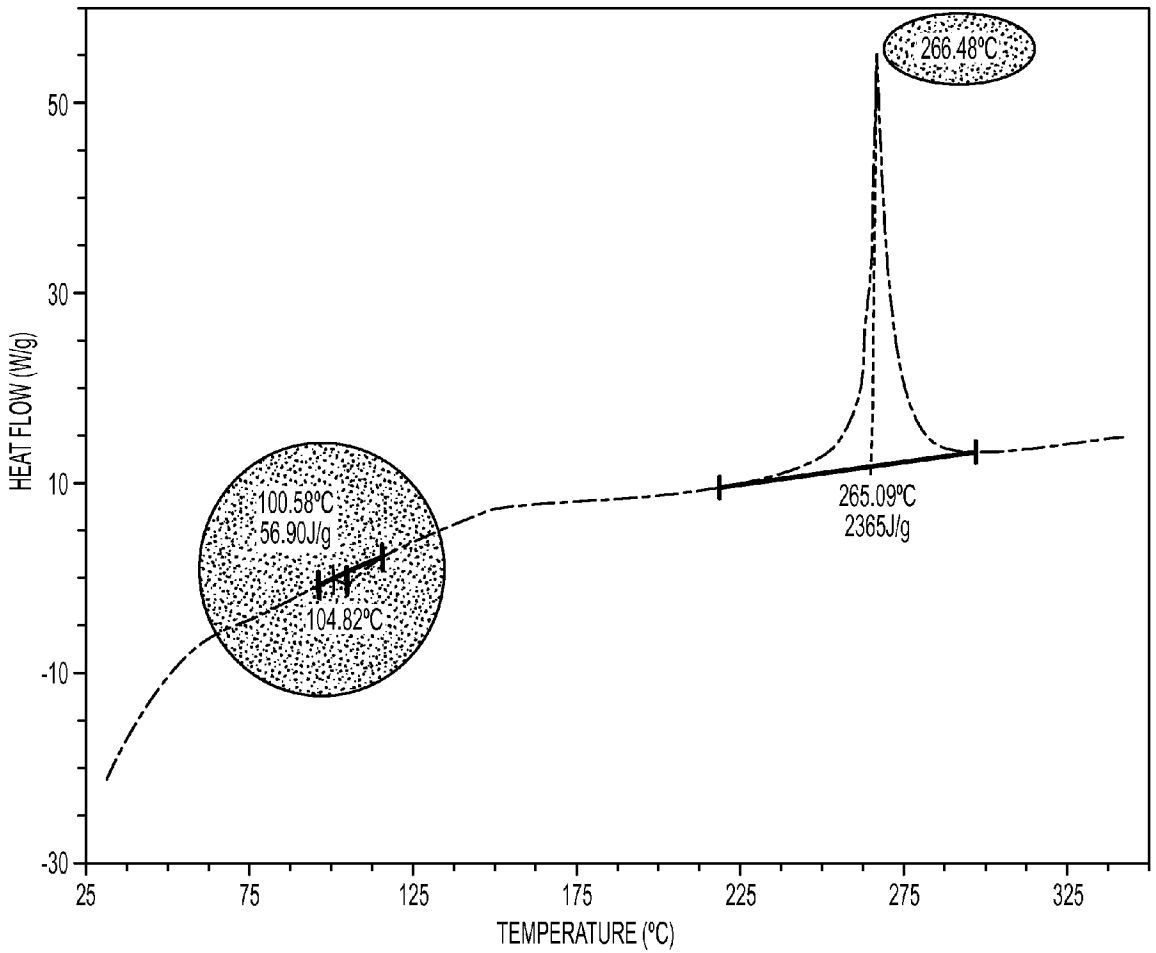
FIG. 3 is a differential scanning calorimetry (DSC) curve for DEMN eutectic produced in accordance with an embodiment of a method of the disclosure, as described in Example 1 herein.

A 25 milliliter (ml) round-bottom flask was fitted with a magnetic stirbar. Water (0.75 grams) was added to the 25-ml round-bottom flask, followed by predetermined quantities of DETA and EDA, to form a DETA/EDA solution. An aqueous 70 wt % $NHO_3$ solution was added to the DETA/EDA solution with stirring to form a reaction mixture. A reaction temperature below about 60° C. was maintained using a cold water bath. The final pH of the reaction mixture was 1. Required quantities of MeNQ and NQ were then added to the reaction mixture. The resulting aqueous slurry was heated to a temperature of from about 110° C. to about 120° C., and a vacuum with a slow air-bleed was applied (0.8 bar) until no water was seen condensing from the molten DEMN eutectic. The molten DEMN eutectic was poured into a polyethylene mold and allowed to solidify. Differential Scanning calorimetry (DSC) analysis was performed on the DEMN eutectic. FIG. 3 illustrates the DSC curve of the DEMN eutectic produced. The DSC analysis results illustrate that DEMN eutectic produced through the methods of the disclosure is the same as DEMN eutectic produced through conventional methods.

Example 2

A three-neck, 100-ml round-bottom flask was fitted with a magnetic stirbar. Water (3.7 grams) was added to the 100-ml round-bottom flask, followed by predetermined quantities of DETA and EDA, to form a DETA/EDA solution. An aqueous 70 wt % $NHO_3$ solution was added to the DETA/EDA solution with stirring to form a reaction mixture. A reaction temperature below about 50° C. was maintained using a cold water bath. The final pH of the reaction mixture was 0.2. Predetermined quantities of wet (i.e., 25 wt % water) MeNQ and wet (i.e., 25 wt % water) NQ were added to the reaction mixture. The resulting aqueous slurry was heated to a temperature of about 105° C., and a vacuum was applied (0.5 bar) until no water was seen condensing from the molten DEMN eutectic. The molten DEMN eutectic was poured into a polyethylene mold and allowed to solidify. The recovered mass of DEMN eutectic was 92% of theoretical.

Example 3

A three-neck, 100-ml round-bottom flask was fitted with a magnetic stirbar. An aqueous 70 wt % $NHO_3$ solution was added to the 100-ml round-bottom flask and cooled to a temperature of about 11° C. A solution of DETA and EDA was added to the aqueous 70 wt % $NHO_3$ solution over 10 minutes. A reaction temperature below about 55° C. was maintained using a cold water bath. The final pH of the resulting reaction mixture was between about 3 and about 4. The reaction mixture was heated to a temperature of about 55° C. to dissolve precipitated solids. MeNQ and NQ were then added in the correct ratios to form an aqueous slurry. The aqueous slurry was heated to a temperature of about 103° C. under air sparge to obtain a clear, amber colored liquid.

Example 4

A 20-liter (L) reactor was charged with an aqueous 70 wt % $NHO_3$ solution. The aqueous 70 wt % $NHO_3$ solution was cooled below about 10° C., and a solution of DETA and EDA was added, with agitation, at a rate sufficient to maintain a reaction temperature below about 50° C. The final pH of the resulting reaction mixture was about 4.2. The reaction mixture was immediately transferred to a 5-gallon, stainless steel melt kettle. Steam was applied to the melt kettle and MeNQ and NQ were added in the correct ratios to form an aqueous slurry. A polyethylene lid fitted with an agitator, air line, thermocouple probe, and vent was fitted onto the melt kettle. Moderate agitation was started and air sparge was applied at 100 standard cubic feet per hour (scfh) to the aqueous slurry. The heating, agitation, and air sparge were continued until the temperature of the molten DEMN eutectic approached the steam temperature (i.e., from about 111° C. to about 118° C.), and remained constant for 1 hour. The heating, stirring, and air sparge were then discontinued, and the molten DEMN eutectic was poured out onto a stainless steel pan to solidify. The recovered mass of DEMN eutectic (i.e., about 54 pounds) was about 98% of theoretical.

While the disclosure is susceptible to various modifications and alternative forms, specific embodiments have been shown by way of example in the drawings and have been described in detail herein. However, the disclosure is not intended to be limited to the particular forms disclosed. Rather, the disclosure is to cover all modifications, equivalents, and alternatives falling within the scope of the present invention as defined by the following appended claims and their legal equivalents.

What is claimed is:

1. A method of producing DEMN eutectic, comprising:

reacting a reactant mixture comprising ethylenediamine and diethylenetriamine with aqueous nitric acid to form a reaction mixture comprising diethylentriamine trinitrate and ethylenediamine dinitrate;

combining the reaction mixture with methylnitroguanidine and nitroguanidine to form an aqueous slurry; and removing water from the aqueous slurry.

2. The method of claim 1, wherein the aqueous nitric acid comprises from about 60 percent by weight nitric acid to about 75 percent by weight nitric acid, and from about 40 percent by weight water to about 25 percent by weight water.

3. The method of claim 1, wherein reacting a reactant mixture comprising ethylenediamine and diethylenetriamine with aqueous nitric acid comprises reacting the reactant mixture with the aqueous nitric acid at a temperature of from about 10° C. to about 90° C.

4. The method of claim 1, wherein reacting a reactant mixture comprising ethylenediamine and diethylenetriamine with aqueous nitric acid comprises reacting the reactant mixture with the aqueous nitric acid at a temperature of from about 35° C. to about 55° C.

5. The method of claim 1, wherein reacting a reactant mixture comprising ethylenediamine and diethylenetriamine with aqueous nitric acid comprises controlling a ratio of the reactant mixture to the aqueous nitric acid such that the reaction mixture exhibits a pH within a range of from about 0 to about 7.

6. The method of claim 1, wherein reacting a reactant mixture comprising ethylenediamine and diethylenetriamine with aqueous nitric acid comprises controlling a ratio of the reactant mixture to the aqueous nitric acid such that the reaction mixture exhibits a pH within a range of from about 3 to about 5.

7. The method of claim 1, wherein combining the reaction mixture with methylnitroguanidine and nitroguanidine comprises combining at least one of methylnitroguanidine in water and nitroguanidine in water with the reaction mixture.

8. The method of claim 1, wherein combining the reaction mixture with methylnitroguanidine and nitroguanidine comprises combining at least one of solid methylnitroguanidine and solid nitroguanidine with the reaction mixture.

9. The method of claim 1, wherein removing water from the aqueous slurry comprises heating the aqueous slurry at a temperature of from about 50° C. to about 150° C.

10. The method of claim 1, wherein removing water from the aqueous slurry comprises heating the aqueous slurry at a temperature of from about 90° C. to about 110° C.

11. The method of claim 1, further comprising exposing the aqueous slurry to at least one of negative pressure and air sparge while removing water from the aqueous slurry.

12. The method of claim 1, wherein removing water from the aqueous slurry comprises heating the aqueous slurry for a sufficient time to form a molten DEMN eutectic comprising ethylenediamine dinitrate, diethylentriamine trinitrate, methylnitroguanidine, nitroguanidine, and from about 0.1 percent by weight water to about 2 percent by weight water.

13. The method of claim 1, wherein heating the aqueous slurry to remove water therefrom comprises heating the aqueous slurry for a sufficient time to form molten DEMN eutectic comprising ethylenediamine dinitrate, diethylentriamine trinitrate, methylnitroguanidine, nitroguanidine, and from about 0.3 percent by weight water to about 0.5 percent by weight water.

14. The method of claim 1, wherein reacting a reactant mixture comprising ethylenediamine and diethylenetriamine with aqueous nitric acid and combining the reaction mixture with methylnitroguanidine and nitroguanidine comprises reacting the reactant mixture with aqueous nitric acid and combining the reaction mixture with methylnitroguanidine and nitroguanidine in a single vessel.

15. A method producing DEMN eutectic, comprising:

reacting a reactant mixture comprising ethylenediamine and diethylenetriamine with an aqueous solution comprising from about 60 percent by weight nitric acid to about 75 percent by weight nitric acid at a temperature of from about 10° C. to about 90° C. to form a reaction mixture comprising ethylenediamine dinitrate and diethylentriamine trinitrate and exhibiting a pH within a range of from about 0 to about 7;

combining the reaction mixture with methylnitroguanidine and nitroguanidine to form an aqueous slurry; and heating the aqueous slurry at a temperature of from about 50° C. to about 150° C. and under at least one of negative pressure and air sparge to form a eutectic composition comprising ethylenediamine dinitrate, diethylentriamine trinitrate, methylnitroguanidine, nitroguanidine, and from about 0.1 percent by weight water to about 2 percent by weight water.

16. The method of claim 15, further comprising cooling the eutectic composition to form a solid eutectic composition.

17. The method of claim 15, further comprising forming particles from the eutectic composition.

* * * * *